United States Patent [19]

Kresta et al.

[11] Patent Number: 4,915,206

[45] Date of Patent: Apr. 10, 1990

[54] MULTIPRICE SETTING SPLIT RING COIN CONTROL MECHANISM

[76] Inventors: Harvey G. Kresta, Rt. 2, Box 222, Hallettsville, Tex. 77964; Ralph J. Ullman, Rt. 2, Box 193, Shiner, Tex. 77984

[21] Appl. No.: 200,076

[22] Filed: May 27, 1988

Related U.S. Application Data

[63] Continuation-in-part of Ser. No. 154,870, Feb. 11, 1988, Pat. No. 4,828,097.

[51] Int. Cl.[4] ..... G07F 5/08; G07F 11/04

[52] U.S. Cl. ..... 194/227

[58] Field of Search ..... 194/226, 227, 223

[56] References Cited

U.S. PATENT DOCUMENTS 2,991,867 7/1961 Schuller ..... 194/226

4,592,461 6/1986 Friedman ..... 194/227

4,747,478 5/1988 Friedman et al. ..... 194/227

*Primary Examiner*—F. J. Bartuska

*Attorney, Agent, or Firm*—Gunn, Lee & Miller

[57] ABSTRACT

A coin control mechanism for use with a dispensing device having an access door. The coin control mechanism includes a door locking assembly disengaged by the action of a totalizer which rotates in response to the denomination of coins dropped through a coin chute. The totalizer is connected to a price control unit comprised of multiple rotatable slotted rings whose slot positions may be changed to reflect different desired cumulative values of coins needed to activate the mechanism by varying the position of the slots with respect to a release bar and the other slots on the split ring assembly. The slotted rings advance towards the release bar in response to the rotation of the totalizer. When a slot engages the release bar, the release latch is activated and the access door is unlatched.

18 Claims, 3 Drawing Sheets

MULTIPRICE SETTING SPLIT RING COIN CONTROL MECHANISM

This application incorporates by reference the specification and drawings of U.S. Pat. No. 4,037,701 ('701) patent, Knickerbocker 1977, and is a continuation-in-part of application Ser. No. 07/154,870 filed Feb. 11, 1988, now U.S. Pat. No. 4,828,097, which also incorporates by reference the '701 patent. For sake of clarification, all the structure added to the structure of the parent application begins with 500.

BACKGROUND OF THE INVENTION

1. Field of the Invention

A coin control mechanism for use in combination with a dispensing device. The mechanism includes a totalizer having at least two possible positions to allow the dispensing device to open when any one of at least two different cumulative values of coins are inserted therein.

2. Description of the Prior Art

U.S. Pat. No. 4,592,461 (Friedman et al, 1986) discloses a coin control mechanism with a totalizer means and a pair of slotted rings. However, the Friedman totalizer comprises a first dog, rotatably connected to a lever, a ratchet wheel which has one tooth that is higher than others, and a stop mechanism to abut against the higher tooth to stop the ratchet wheel from rotating. These elements are structurally different from the present invention and interact in a different manner in to changing the dispensing (activation) position of the totalizer. In addition, the present invention incorporates fewer mechanical parts to perform similar functions, those functions being the ability to quickly change the dispenser positions of the totalizer and the activation of the coin control mechanism to allow access to the dispensing machine.

SUMMARY OF THE INVENTION

A coin control mechanism for use with a dispensing device having an access door. The coin control mechanism includes a door locking assembly disengaged by the action of a totalizer which rotates in response to the denomination of coins dropped through a coin chute, with greater rotation for coins of higher denomination. The totalizer is connected to a price control unit comprised of multiple rotatable slotted rings whose slot positions may be changed to reflect different desired cumulative values of coins needed to activate the mechanism by varying the position of the slots with respect to a release bar and the other slots on the split ring assembly.

The present invention relates to a coin control mechanism for use in combination with a periodical dispensing device having an access door including a lock operatively controlled by the coin control mechanism. More specifically, the coin control mechanism of the present invention comprises a totalizer and a coin chute arranged relative to one another such that as coins pass through the coin chute they engage the totalizer to advance the totalizer in response to the denomination of the coins. The lock of the dispensing device is released upon the totalizer reaching a dispensing or activation position registering a predetermined total cumulative value of coins inserted.

It is an object of the present invention to provide a means for quickly changing between the upper limit of coin values and the lower limit of coin values required to operate the coin control mechanism and allow access to the dispensing device.

It is a further object of the present invention to provide a split ring assembly by which the dispensing or activation position of the totalizer can be preset to different limits, where the number of such limit positions is determined by the number of rings on the split ring assembly.

It is a further object of the present invention to provide a means for rapidly changing the dispensing or activation positions at which the totalizer of the coin control mechanism will release the dispenser and allow access thereto.

BRIEF DESCRIPTIONS OF THE DRAWINGS

BRIEF DESCRIPTION OF THE PREFERRED EMBODIMENT

A coin control mechanism for use with a dispensing device having an access door. The coin control mechanism includes a door locking assembly disengaged by the action of a totalizer which rotates in response to the denomination of coins dropped through a coin chute. The totalizer is connected to a price control unit comprised of multiple rotatable slotted rings whose slot positions may be changed to reflect different desired cumulative values of coins needed to activate the mechanism by varying the position of the slots with respect to a release bar and the other slots on the split ring assembly.

Figure 1:
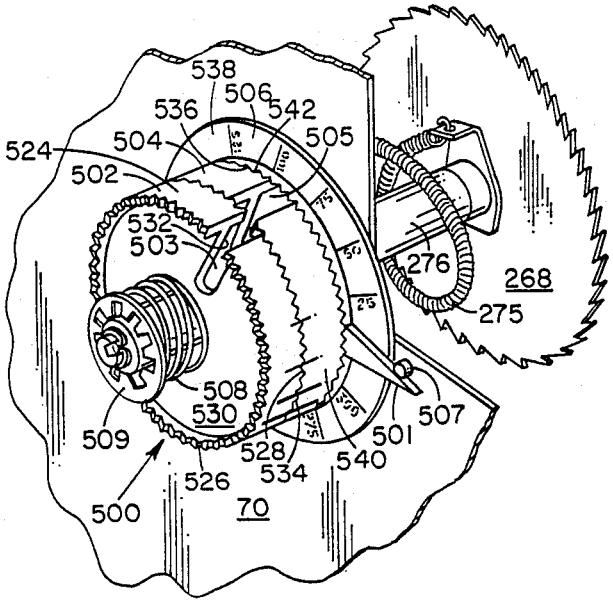
FIG. 1 is a perspective of the slotted split rings of the price control unit.
Figure 2:
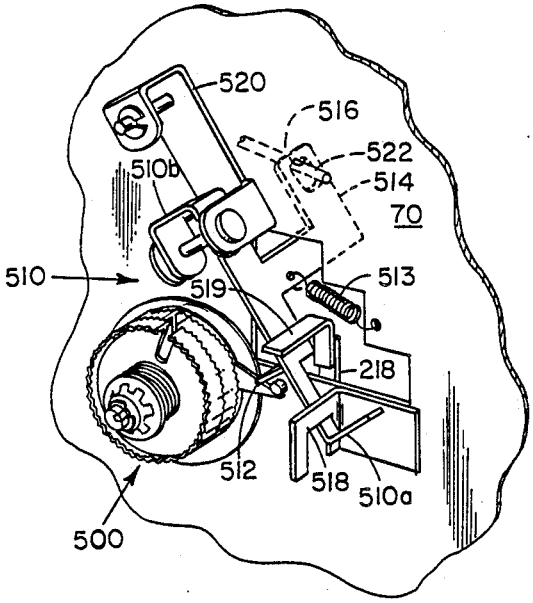
FIG. 2 is a perspective of the price control unit showing the slotted rings and the release bar.

This invention replaces various components of the '701 patent a split ring assembly 500, and release bar 510 and structure associated therewith as shown in FIGS. 1 and 2. Specifically, the structure in the '701 patent which is replaced is: wheel 272, adjustable limit means 98 and 100, limit stop 280, mounting member 278, apertures 111, and stud or pin 109.

FIG. 1 is a perspective of the slotted split rings of the price control unit apart from the coin control mechanism. As can be seen in FIG. 1, split ring assembly 500 is comprised of three main parts, top ring 502, bottom ring 504 and base plate 506. Top ring 502 contains top ring slot 503 extending through outer annulus 524, which has serrated or bitted circumferencial ridges 526 and 528 along the upper and lower perimeter thereof. Top ring 502 also has top face 530 and bottom face 532. Bottom ring 504 has bottom ring slot 505 extending through outer annulus 540, which has serrated or bitted circumferencial serrated ridges 534 and 536 along the upper and lower perimeter thereof.

Base plate 506 is generally planar and lies generally flush against coin mechanism mounting plate 70. Base plate 506 has plate stop 501 integral therewith and projecting therefrom, which contacts peg stop 507, which is mounted on mounting plate 70, when base plate 506 rotates. Base plate 506 contains an annular ring of serrated ridges 542 on top face 538 thereof. Base plate 506 is rigidly mounted to stud 276 which extends through mounting plate 70 and to which wheel 268 of the totalizer is also fixedly attached. Wheel 268, base plate 506, top ring 502 and bottom ring 504 are biased in a counterclockwise direction by bias means 275 coupled to wheel 268 for rotating on stud 276. Therefore, wheel 268, base plate 506, top ring 502 and bottom ring 504 move synchronously as one and are normally biased in the counterclockwise direction.

Spring 508 and spring fastener 509 bias top ring 502 against bottom ring 504 and base plate 506. Since the bits on serrated ridges 526, 528, 534, 536 and 542 match, spring 508 will normally lock the three so split ring assembly 500 may move as a unit.

FIGS. 2 through 5 show a perspective of the price control unit showing rings 502 and 504 and release bar 510, a side view of release bar 510 in a lowered position, a side view of release bar 510 in a raised position, and a perspective view from within the coin control mechanism of release bar 510.

Release bar 510 is comprised of release bar prong 512, release bar member 514, and release bar slot 516. Release bar 510 is movable so it may be located in one of four positions, depending upon position of the key and the position of dispenser activator 218. The four positions, by location of release bar 510 with respect to plate 70 and rings 502 and 504 are: raised and open, lowered and open, raised and closed, and lowered and closed. The terms "raised" and "lowered" refer to the position of far end 510*a* of release bar 510. The terms "open" and "closed" refer to the position of far end 510*a* either away from or against split ring assembly 500.

Figure 3:
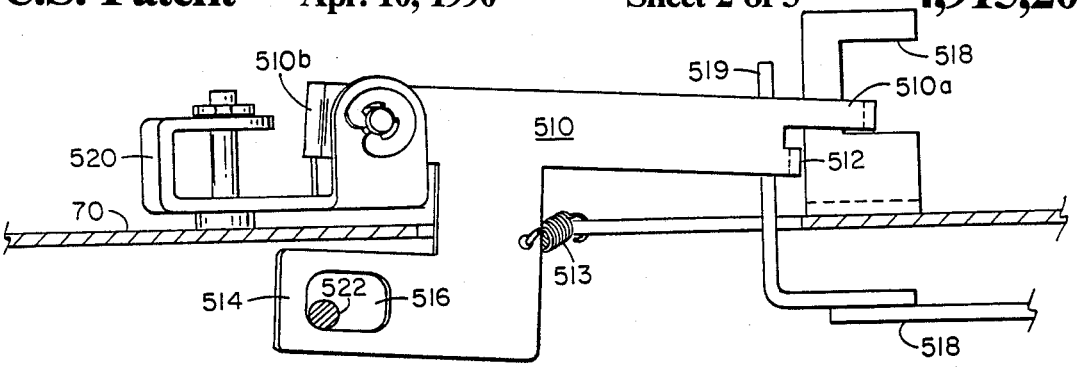
FIG. 3 is a side view of the release bar mechanism with the release bar in a lowered position.
Figure 4:
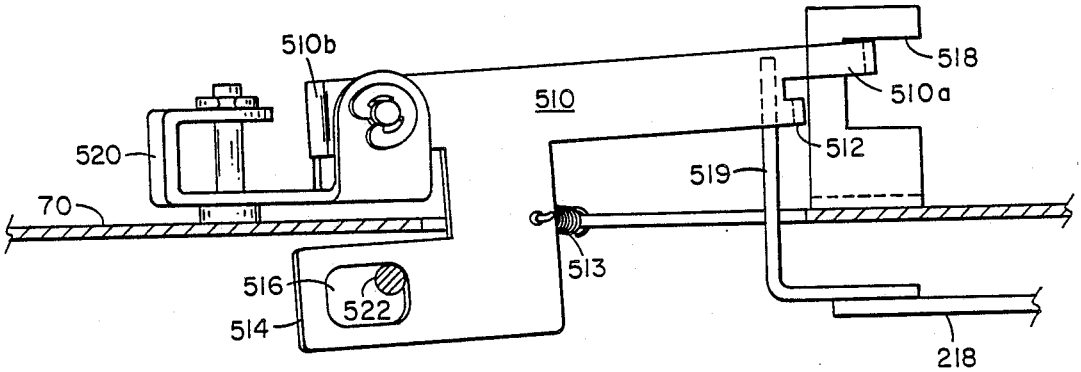
FIG. 4 is a side view of the release bar mechanism with the release bar in a raised position.
Figure 5:
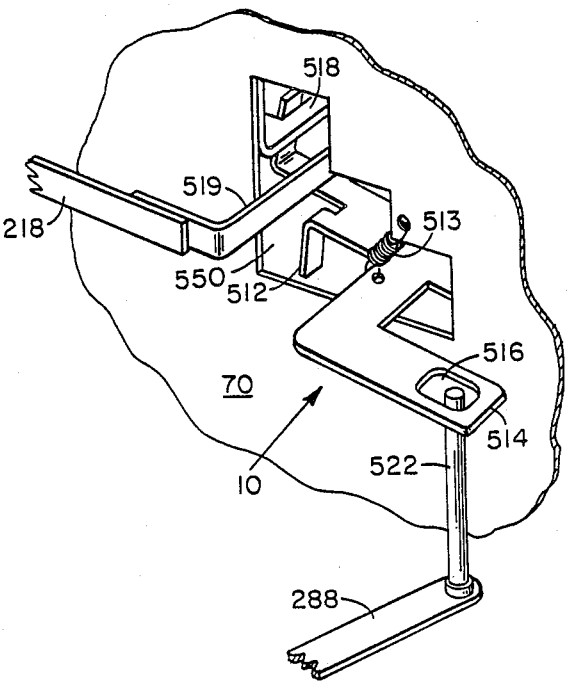
FIG. 5 is a perspective from within the coin control mechanism of the release bar mechanism.
Figure 5A:
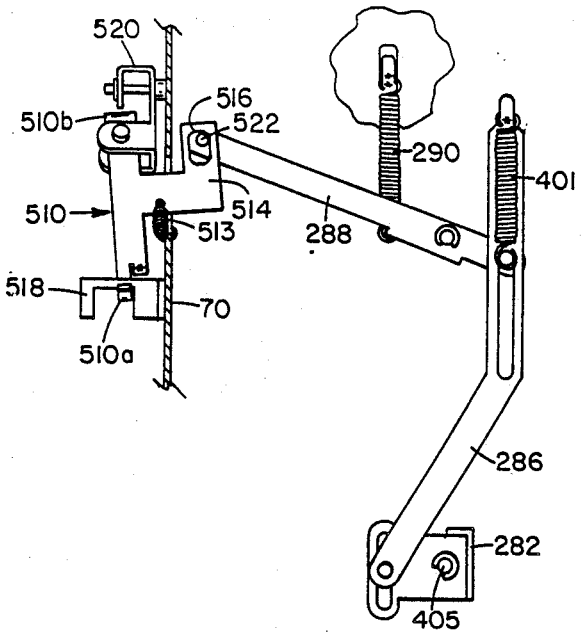
FIG. 5A is a cut away side view of the release bar mechanism illustrating the release bar in a lowered position.
Figure 5B:
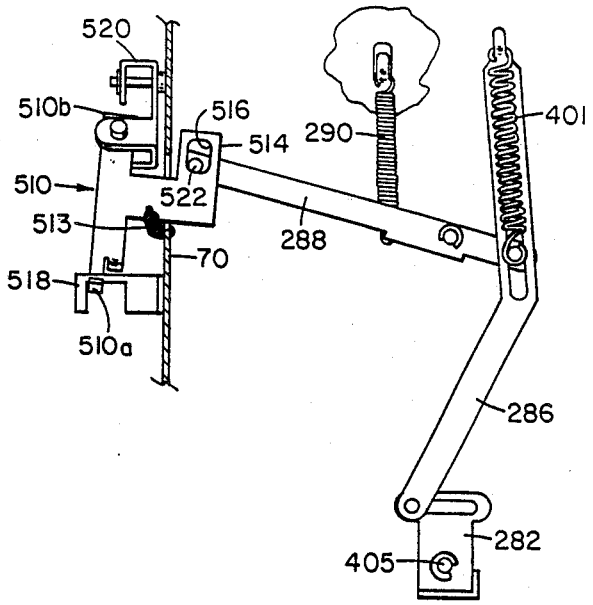
FIG. 5B is a cut away side view of the release bar mechanism illustrating the release bar in a raised position.

The raised position can be seen illustrated in FIG. 4 and the lowered position in FIG. 3. When the release bar is closed, it is flush against split ring assembly 500; and when it is open, it is away from split ring assembly 500 and against release bar stop 518. In the manner more fully set forth below when the key is in a 0° position (arbitrarily chosen), corresponding to a lower limit of coin totals required to activate the dispenser, far end 510*a* is in a raised position as illustrated in FIG. 4 and 5*b*, and is lying generally in the plane of top ring 502. When the key is rotated to 90° far end 510*a*, moves to a lowered position as illustrated in FIG. 3 and 5A, and is lying generally in the plane of bottom ring 504. Near end 510*b* of release bar 510 is attached to release bar gimbal 520, and release bar 510 is free to pivot in the plane of mounting plate 70. In addition, release bar 510 can pivot vertically away from mounting plate 70 from the point where it attaches to gimbal 520.

Also illustrated in FIGS. 2 and 3 is dispenser actuator extend 519. Release bar bias spring 513 will normally bias release bar 510 against release bar stop 518 which is mounted on mounting plate 70. Extending through opening 550 (FIG. 5) in mounting plate 70 is release bar member 514 which contains release bar slot 516 therein. Release bar interconnect 522 extends perpendicular from interconnect 286 (see also FIG. 5 of the '701 patent) to engage release bar 510.

FIGS. 5A and 5B are included to illustrate the manner in which release bar 510 and the structure associated therewith engages the structure of the '701 patent. More specifically, it can be seen how linkages 282, 286 and 288, spring bias means 290, spring 501 and pin 505 are generally the same as disclosed in the parent application. However, instead of linkage 288 connecting to mounting member 278 as is disclosed in the '701 patent, linkage 288 is coupled to release bar 510 through interconnect 522.

OPERATION OF SPLIT RING ASSEMBLY

Split ring assembly 500 allows the vendor to choose between two different coin totals required to activate the dispensing machine and allow access to the merchandise contained therein. After the totals are set at an upper limit and a lower limit by rotation of the split ring assembly 500 as described more fully below, coin control mechanism 52 may be then quickly changed from the outside between the upper limit and the lower limit by rotating the key.

Split ring assembly 500 and release bar 510 allow the operator to quickly change and preset the dispensing position of the totalizer at any one of a plurality of positions. These positions set an upper limit coin total and a lower limit coin total required to activate the dispensing machine.

The upper limit will reflect a larger total value of coins that will allow access to the machine than the lower limit. To set these limits, the vendor may position split ring assembly 500 so the dispensing position of the totalizer is set at an upper limit reflecting a denomination value of (for example) $1.50 and the lower limit reflecting a coin denomination value of (for example) $0.25. Thereafter, a quick change between these two limit positions may be made by the vendor from the outside of the machine through the use of a key.

The rotation of the key rotates interconnect member 282 and transfers that rotation through linkage 286 to linkage 288 as illustrated in FIGS. 5A and 5B. However, unlike the '701 patent in which linkage 288 actuates mounting member 278, here linkage 288 connected to release bar interconnect 522 and movement of linkage 288 is therefore translated to release bar 510.

When the key is at 0° (arbitrarily chosen) as shown in FIG. 5A, interconnect member 282 is positioned as illustrated. Linkage 286 maintains the location of linkage 288 through the bias of spring 501. In this first position, release bar member 510 is in the lower position as shown in FIG. 3 such that far end 510*a* release bar prong 512 is aligned with bottom ring 504.

When the key is rotated 90°, interconnect member 282 is positioned as illustrated in FIG. 5B. Such rotation shifts linkage 286, actuating interconnect linkage 288, which pivots far end 510*a* to a raised position as illustrated in FIG. 4, through the action of release bar interconnect 522. Because linkage 288 is fixedly connected to release bar interconnect 522, release bar 510 is allowed to change between the raised position (FIG. 4) and the lowered position (FIG. 3).

Dispenser actuator extend 519 is biased clockwise against release bar 510 by bias spring 234, and causes release bar prong 512 of release bar 510 to press against split ring assembly 500 when the coin control mechanism 52 is in a locked, non-dispensing position.

The preset non-dispensing position of the totalizer is fixed by the position of plate stop 501 as it rests against peg stop 507. As coins are placed into the coin chute and activate the totalizer, the totalizer begins advancing towards the dispensing position. Split ring assembly 500 advances along with the totalizer. As this occurs, both top ring slot 503 and bottom ring slot 505 approach release bar prong 512. If the key is in the first position (0°), release bar 510 will be in a lower position (FIG. 3 and 5A) and release bar prong 512 will ultimately engage bottom ring slot 505. On the other hand, if the key is in the second position (90°), release bar 510 will be in a raised position (FIG. 4 and 5B), and release bar prong 512 will ultimately engage top ring slot 503. In either case, when release bar prong 512 enters a slot (503 or 505), dispenser actuator 218 will release locking mechanism, allowing access to the dispenser.

Two different dispensing positions, representing upper and lower coin value totals, may be set by the vendor by raising top ring 502 and/or bottom ring 504 away from base plate 506 and repositioning slots 503 and 505 with respect to base plate 506 while allowing plate stop 501 to rest against peg stop 507 (the non-dispensing position of totalizer). Base plate 506 is preferably marked with denominations (see FIG. 1) illustrating the positions over which either slot (403 or 505) may be set. For example, bottom ring slot 505 may be set over the "50" position which represents coins totalling $0.50. At the same time, the operator may raise top ring 502 and twist it so top ring slot 503 is above the "100" mark on base plate 506. The operator has thereby quickly and easily set a lower limit of totalizer at $0.50 and an upper limit of totalizer at $1.00 for coin control mechanism 52.

Terms such as "left," "right," "up," "down," "bottom," "top," "front," "back," "in," "out," "clockwise," "counterclockwise" and the like are applicable to the embodiment shown and described in conjunction with the drawings. These terms are merely for the purposes of description and do not necessarily apply to the position in which the device may be constructed or used.

Although the invention has been described with reference to a specific embodiment, this description is not meant to be construed in a limiting sense. Various modifications of the disclosed embodiments will become apparent to those skilled in the art upon reference to the description of the invention. It is therefore contemplated that the appended claims will cover such modifications that fall within the true scope of the invention.

I claim:

1. A coin mechanism device for use with a dispensing machine accessible from the outside for quickly changing the value of coins required to activate the coin mechanism between resetable high and low values of coins, the coin mechanism having a totalizer that advances from a non-dispensing position to a dispensing position as coins are inserted into the coin mechanism, the device comprising:

rotation means rotatable between a first angular position and a second angular position, said rotation means being accessible from the outside of said coin mechanism;

a price control unit comprised of at least a first ring, a second ring, and a release bar in operative association with said rotation means, said first ring and said second ring rotatably mounted to said totalizer and advancing therewith from the non-dispensing position to the dispensing position as coins are inserted into the coin mechanism;

said release bar having a first end and a second end, said first end being fixed and said second end being movable for positioning against said first ring when said rotation means is in the first angular position, and against said second ring when said rotation means is in the second angular position, wherein said release bar of said price control unit further comprises a release bar bracket, said release bar bracket attached to a housing of the coin mechanism device and to said first end of said release bar for allowing said release bar to pivot in a plane perpendicular to the plane of said totalizer and also pivot in a plane parallel to the plane of said totalizer;

said first ring having a first ring slot therein, the position of the first ring slot being changeable with respect to said release bar by rotating said first ring, the position of said first ring slot determining a lower limit of the totalizer;

said second ring having a second ring slot therein, the position of the second ring slot being changeable with respect to said release bar by rotating said second ring, the position of said second ring slot determining an upper limit of the totalizer;

wherein said totalizer causes said first ring and said second ring to rotate from a non-dispensing position to a dispensing position in response to the insertion of coins into said coin mechanism, said release bar is urged against said first ring when said rotation means is rotated to said first angular position, or said second ring when said rotation means is rotated to said second angular position, said release bar engages the desired ring slot when the desired ring slot reaches the dispensing position and the engagement releases means which allow access to the dispensing machine.

2. The coin mechanism device as described in claim 1 wherein said price control unit further comprises a base plate fixedly attached to said totalizer and rotatable therewith and a stop means integral with said base plate said stop means for locating the non-dispensing position of the totalizer.

3. The coin mechanism device as described in claim 2 wherein said stop means includes a tooth projecting from said base plate and a peg attached to a housing of the coin mechanism device, said peg located to intercept said tooth when said totalizer and said base plate are biased towards said peg, said peg position thereby locating the non-dispensing position of said totalizer.

4. The coin mechanism device as described in claim 2 further including a coupling means in operative association with said base plate, said first ring and said second ring, so that as coins are inserted into the coin mechanism device, said totalizer, said base plate, said first ring and said second ring move simultaneously from the non-dispensing position to the dispensing position.

5. The coin mechanism device as described in claim 4 wherein said coupling means further comprises a first bitted set, a second bitted set, and a bias means; the first bitted set comprising a first bitted annulus on the top surface of said base plate and a matching second bitted annulus in opposed relation on the bottom surface of said first ring, the second bitted set comprising a third bitted annulus on the top surface of said first ring and a matching fourth bitted annulus in opposed relation on the bottom surface of said second ring; wherein said bias means locks the bitted sets together and allows said base plate, said first ring and said second ring to rotate as a unit simultaneous with the rotation of said totalizer.

6. The coin mechanism device as described in claim 5 wherein the planes of said base plate, said first ring and said second ring are generally parallel, and perpendicular to the axis of rotation of said base plate, said first ring, said second ring and said totalizer.

7. The coin mechanism device as described in claim 1 wherein said price control unit further comprises release bar stop means and bias means, the bias means for urging the release bar against stop means when the access means is released.

8. The coin mechanism device as described in claim 1 further comprising a release bar bias means for urging said release bar against the desired ring while said access means prevents access to the dispensing machine and for retracting release bar from said slot of the desired ring following engagement of said release bar with said slot of the desired ring and access to the dispensing machine.

9. A coin control mechanism for use with a dispensing machine having latch means, the coin control mechanism comprising:

a housing;

coin chute means for receiving the coins therein;

activator means movably attached to said housing to lockingly engage the latch means;

totalizer means movable between a non-dispensing position and a dispensing position disposed relative to said coin chute means to advance from the non-dispensing position to the dispensing position in response to coins fed through said coin chute means;

multiprice setting means for setting the non-dispensing position of the totalizer means and for quickly changing the dispensing position of the totalizer means between an upper and a lower limit, wherein said multiprice setting means comprises a first ring with a first slot therein and a second ring with a second slot therein and a release bar, which, when located in a first position is movable against the first ring and when located in a second position is movable against the second ring and when located in a retracted position is away from the rings, wherein said multiprice setting means further includes a release bar bracket, and wherein said release bar contains a first end and a second end, the first end connected to said release bar bracket and capable of allowing said release bar to move in a plane perpendicular to the plane of said totalizer means and also in a plane parallel to the plane of said totalizer means;

adjustable price setter means in operative association with said multiprice setter means for changing the dispensing position of the totalizer means between the upper limit and the lower limit by changing the release bar from the first position to the second position;

means coupled to said adjustable price setter means to change said adjustable price setter means between a first angular position and a second angular position;

wherein said coupling means when locating said adjustable price setter means at the first angular position thereby locates said release bar in the first position, movable against the first ring, for engagement therewith, and when locating said adjustable price setter means at the second angular position thereby locates said release bar in the second position, movable against the second ring for engagement therewith, said totalizer means for advancing from the non-dispensing position to the dispensing position in response to coins inserted into the coin chute means, said release bar, being urged against the desired ring, for engagement with the desired slot, such engagement causing said activator means to disengage the latch means and thereby allow access to the dispensing machine.

10. The coin mechanism device as described in claim 9 wherein said multiprice setting means further includes a base plate with a tooth, the tooth being integral with said base plate and projecting therefrom and a peg stop, the peg stop being fixedly mounted on said housing to engage said base plate, said totalizer means being located at the nondispensing position when the tooth of said base plate is contacting the peg.

11. The coin mechanism device as described in claim 10 further including an interlock set means in operative association with said multiprice setting means to permit said first ring, said second ring and said base plate to move synchronously with one another and with said totalizer means as said totalizer means advances from the non-dispensing position to the dispensing position in response to coins inserted into said coin chute means.

12. The coin mechanism as described in claim 11 wherein said interlock set means further comprises a spring with a spring detain means, a first ring lock means and a second ring lock means, wherein the spring urges said second ring against said first ring and said first ring against said base plate, the urging causing engagement of said second ring lock means to fix the angular slot position of said second ring with respect to said first ring and also causing engagement of said first ring lock means to fix the angular slot position of said first ring with respect to said base plate, the angular slot position of said rings determining the dispensing position of said totalizer means and capable to being changed by disengaging the desired ring lock means and rotating the desired ring until the ring slot is in the desired position, such desired position determining the dispensing position of said totalizer means.

13. The coin mechanism as described in claim 9 wherein said multiprice setting means further includes a base plate with a tooth, the tooth being integral with said base plate and projecting therefrom and a peg stop, the peg stop being fixedly mounted on said housing to engage said base plate, said totalizer mean being located at the non-dispensing position when the tooth of said base plate is contacting the peg; and further including an interlock set means in operative association with said multiprice setting means to permit said first ring, said second ring and said base plate to move synchronously with one another and with said totalizer means as said totalizer means advances from the non-dispensing position to the dispensing position in response to coins inserted into said coin chute means.

14. The coin mechanism as described in claim 13 wherein the interlock set means further comprises a spring with a spring detain means, a first ring lock means and a second ring lock means, wherein the spring urges said second ring against said first ring and the first ring against said base plate, the urging causing engagement of said second ring lock means to fix the angular slot position of said second ring with respect to said first ring and also causing engagement of said first ring lock means to fix the angular slot position of said first ring with respect to said base plate, the angular slot position of said rings determining the dispensing position of said totalizer means and capable to being changed by disengaging the desired ring lock means and rotating the ring until the desired ring slot is in the desired position, such desired position determining the dispensing position of said totalizer means.

15. The coin mechanism device as described in claim 9 wherein the plane of said the first ring, the plane of said second ring and the plane of said totalizer means are generally parallel.

16. The coin mechanism as described in claim 9 wherein said multiprice means further includes a release bar bracket, and wherein said release bar contains a first end and a second end, the first end connected to said release bar bracket and capable of allowing said release bar to move in a plane perpendicular to the plane of said totalizer means and also in a plane parallel to the plane of said totalizer means; and wherein said multiprice means further includes a base plate with a tooth, the tooth being integral with said base plate and projecting therefrom and a peg stop, the peg stop being fixedly mounted on said housing to engage said base plate, said totalizer means being located at the non-dispensing position when the tooth of said base plate is contacting the peg.

17. The coin mechanism as described in claim 16 further including an interlock set means in operative association with said multiprice setting means to permit said first ring, said second ring and said base plate to move synchronously with one another and with said totalizer means as said totalizer means advances from the non-dispensing position to the dispensing position in response to coins inserted into said coin chute means.

18. A coin mechanism device for use with a dispensing machine accessible from the outside for quickly changing the value of coins required to activate the coin mechanism between resetable high and low values of coins, the coin mechanism having a totalizer that advances from a non-dispensing position to a dispensing position as coins are inserted into the coin mechanism, the device comprising:

rotation means rotatable between a first angular position and a second angular position, said rotation means being accessible from the outside of said coin mechanism;

a price control unit comprised of a first ring, a second ring, a base plate, a coupling means, a release bar, a release bar bracket, a release bar stop means and a release bar bias means, said first ring, said second ring, and said base plates rotatable mounted to the totalizer and advancing therewith from the non-dispensing position to the dispensing position as coins are inserted into the coin mechanism, wherein the planes of said first ring, said second ring, said base plate and the totalizer are generally parallel and perpendicular to the axis of rotation of said first ring, said second ring, said base plate and the totalizer;

said release bar having a first end and a second end, the first end being attached to said release bar bracket, which is in turn attached to a housing of the coin mechanism device, the second end of said release bar being free, the attachment of the first end for allowing said release bar to pivot therefrom in a plane perpendicular to the plane of said totalizer and also in a plane parallel to the totalizer;

said base plate, fixedly attached to the totalizer and rotatable therewith, further including a tooth projecting from said base plate for intercepting a peg attached to the housing of the coin mechanism and thereby locating the non-dispensing position of the totalizer;

said first ring having a first ring slot therein, the position of the first ring slot changeable with respect to the position of said release bar by rotating said first ring, the position of said first ring slot determining a lower limit of the totalizer;

said second ring having a second ring slot therein, the position of the second ring slot changeable with respect to the position of said release bar by rotating said second ring, the position of said second ring slot determining an upper limit of the totalizer;

said coupling means comprising a first bitted set, a second bitted set, and a bias means; the first bitted set comprising a first bitted annulus on said base plate and a matching interlockable second bitted annulus in opposed relation on the bottom surface of said first ring, the second bitted set comprised of a third bitted annulus on the top surface of said first ring and a matching interlockable fourth bitted annulus in opposed relation on the bottom surface of said second ring; wherein said bias means locks the bitted sets together and allows said base plate, said first ring and said second ring to rotate as a group simultaneously with the rotation of the totalizer, wherein the vendor may change the position of the desired ring slot by unlocking the appropriate bitted set and rotating the desired ring such that the desired ring slot is in the desired position, such position representing the dispensing position;

wherein the totalizer causes said first ring or said second ring to rotate from a non-dispensing position to a dispensing position in response to the insertion of coins into said coin mechanism, said release bar is urged against said first ring when said rotation means is rotated to said first angular position, or said second ring when said rotation means is rotated to said second angular position, said release bar engages the desired ring slot when the desired ring slot reaches the dispensing position and the engagement releases means which allow access to the dispensing machine.

* * * * *